US011335497B2

(12) United States Patent
Elliott

(10) Patent No.: US 11,335,497 B2
(45) Date of Patent: May 17, 2022

(54) ELECTROMAGNETIC COILS AND METHODS OF MAKING SAME

(71) Applicant: Meggitt Aerospace Limited, Coventry (GB)

(72) Inventor: Christopher Simon Elliott, Redditch (GB)

(73) Assignee: MEGGIT AEROSPACE LIMITED, Coventry (GB)

( * ) Notice: Subject to any disclaimer, the term of this patent is extended or adjusted under 35 U.S.C. 154(b) by 603 days.

(21) Appl. No.: 15/242,480

(22) Filed: Aug. 19, 2016

(65) Prior Publication Data

US 2018/0053595 A1 Feb. 22, 2018

(51) Int. Cl.

| | |
|---|---|
| ***H01F 17/04*** | (2006.01) |
| ***H01F 27/32*** | (2006.01) |
| ***H01F 27/28*** | (2006.01) |
| ***H01F 41/066*** | (2016.01) |
| ***H01F 41/12*** | (2006.01) |
| ***H01B 7/29*** | (2006.01) |
| ***H01F 5/06*** | (2006.01) |

(52) U.S. Cl.

CPC ..... *H01F 27/32* (2013.01); *H01B 7/292* (2013.01); *H01F 5/06* (2013.01); *H01F 27/2823* (2013.01); *H01F 27/325* (2013.01); *H01F 41/066* (2016.01); *H01F 41/127* (2013.01)

(58) Field of Classification Search

CPC ..... H01F 27/32
USPC ..... 336/221
See application file for complete search history.

(56) References Cited

U.S. PATENT DOCUMENTS

| | | | | |
|---|---|---|---|---|
| 2,899,403 A | | 8/1959 | Lewis | |
| 2,941,905 A | | 6/1960 | Hofmann | |
| 3,018,321 A | * | 1/1962 | Hermann | H01F 41/122 174/110 R |
| 3,024,340 A | * | 3/1962 | Bigeault | F24D 13/024 219/213 |
| 3,487,123 A | * | 12/1969 | Ignaz | C08K 5/00 526/261 |
| 6,022,904 A | * | 2/2000 | Sollradl | C08J 9/02 521/154 |
| 6,393,691 B1 | * | 5/2002 | Ogawa | H01F 17/045 29/602.1 |

(Continued)

FOREIGN PATENT DOCUMENTS

| | | |
|---|---|---|
| EP | 1808869 A2 | 7/2007 |
| JP | S5789211 A | 6/1982 |
| JP | 2002042552 A | 2/2002 |

OTHER PUBLICATIONS

English translation of JPS5789211 (Year: 1982).*

(Continued)

*Primary Examiner* — Ronald Hinson
(74) *Attorney, Agent, or Firm* — Hackler Daghighian Martino & Novak

(57) ABSTRACT

An electromagnetic coil that can withstand high temperatures and operate efficiently and methods of making the same are provided. In preferred embodiments the electromagnetic coil comprises: a bobbin made entirely of ceramic; a coiled conductor wrapped around the bobbin; a potting resin applied to the coiled conductor during winding wherein, the resin is a siloxane polymer mixed with a metal oxide or a cyanate ester; and an overwind made of glass fiber yarn.

11 Claims, 5 Drawing Sheets

(56) References Cited

U.S. PATENT DOCUMENTS

| | | | |
|---|---|---|---|
| 6,407,339 | B1 | 6/2002 | Rice et al. |
| 6,465,097 | B1 | 10/2002 | Ueoka et al. |
| 9,175,137 | B2 | 11/2015 | Sahagun et al. |
| 9,183,970 | B2 | 11/2015 | Maeda et al. |
| 2007/0190332 | A1 | 8/2007 | Schaal et al. |
| 2016/0297993 | A1* | 10/2016 | Vanier ..... B32B 27/00 |

OTHER PUBLICATIONS

English translation of JP356079600 (Year: 1981).*
English translation of JP362162321 (Year: 1987).*
Rice, John, et al.; Abstract—Enhanced Adhesive Shear Strength of Cyanate Ester Electrical Insulation for Fusion Magnets, IEEE Transactions on Applied Superconductivity (vol. 13, Issue 2), pp. 1476-1479; Published Jun. 2003; Current Version Jul. 15, 2003, USA. http://ieeexplore.ieee.org/Xplore/home.jsp.
Davis, S.R., et al.; Abstract—Manufacture and Test of a Prototype Cyanate Ester Coil; IEEE Transactions on Applied Superconductivity (vol. 20, Issue 3); pp. 1479-1483; Published Mar. 18, 2010; Current Version May 24, 2010; Issued Jun. 2010, USA. http://ieeexplore.ieee.org/Xplore/home.jsp.
Alemany, R., et al.; Abstract—Technical Feasibility Studies for the CMS Tracker Position Monitoring System, The Compact Muon Solenoid Experiment, CMS Note 2001/006; pp. 1-30; Feb. 7, 2001, Geneva, Switzerland.
Fabian, et al.; Abstract—Noval Radiation-Resistant Insulation Systems for Fusion Magnets, 6th International Symposium on Fusion Nuclear Technology (ISFNT), Apr. 2002, pp. 1-6; Lafayette, Colorado, USA Wien, Austria.
Nelson, B. et al.; Engineering Design Status of the Quasi-Poloidal Stellarator (QPS) ResearchGate, Conference Paper, Oct. 2005; pp. 1-6; Tennessee, USA; New Jersey, USA. https://www.researchgate.net/publication/224673716.
Prokopec, R., et al.; Characterization of Advanced Cyanate Ester/Epoxy Insulation Systems Before and After Reactor Irradiation; Fusion Engineering and Design 85 (2010), pp. 227-233; Accepted Jan. 19, 2010; University of Technology, Atominstitut, Vienna, Austria.
Zeller, A.F., Final Report On Radiation Resistant Magnets II, NSCL, Michigan State University, pp. 1-7, East Lansing, Michigan, USA.
European Patent Office, Communication, Extended European Search Report, dated Jan. 29, 2018, pp. 1-8; Munich, Germany.

* cited by examiner

ELECTROMAGNETIC COILS AND METHODS OF MAKING SAME

FIELD

The present patent document relates generally to devices having electrical windings and methods for making the same. More specifically, the present patent document relates to electromagnetic coils that can withstand harsh environments, can be cost effectively manufactured and can efficiently operate.

BACKGROUND

Electrical windings are the building blocks of many devices including actuators, electromagnets, inductors, transformers and transducers to name a few. Many of these devices are used in aerospace applications and other applications where they may face harsh environments such as extreme temperatures and high vibration. In order to be effective, these devices need to operate efficiently and need to meet a weight tolerance.

FIG. 1 is a trace from a fireproof test which shows what typically happens when you expose conventional coils to excessive heat. In this instance the test was performed at a constant electrical current through the solenoid coil. The voltage is plotted along the Y-axis as a function of time along the X-axis. As the fire test heats the unit the voltage increases, because the coil resistance increases with temperature. After approximately 350 s, the organic insulation on the coil wires starts to char, leaving carbon rich compounds which are conductive, leading to a drop in voltage as the overall coil resistance drops. This typically occurs in several distinct phases due to the specific chemistry at any given point. Functional failure occurred after approximately 450 s when there were insufficient functional turns in the coil to maintain the magnetic field.

Many of the previous designs that try to address failures due to temperature exposure like the one shown in FIG. 1 require the wire used for the coil to be specially processed before winding. For example, U.S. Pat. No. 6,407,339 (hereinafter "'339 Patent"), describes the use of high temperature electrical insulation which may be used with windings. However, the'339 Patent requires that the conductor first be wrapped with an impregnated tape before being wound into a coil. This step is time consuming and costly. Moreover, once wrapped, the wire would have a poor packing factor and its efficiency would be affected. Such devices typically become too large and heavy for use in aerospace applications.

Thus, there is a need in the art for an electrical winding and methods of making the same that can better withstand exposure to temperature and other environments while still operating efficiently. These designs would be preferably still cost effective to manufacture and be efficient enough to keep their weight down.

SUMMARY OF THE EMBODIMENTS

Objects of the present patent document are to provide improved electromagnetic coils and methods of making the same. To this end, in one embodiment, an electromagnetic coil is provided. The electromagnetic coil comprises: a bobbin made entirely of ceramic; a coiled conductor wrapped around the bobbin; a potting resin applied to the coiled conductor during winding wherein, the resin is a siloxane polymer mixed with a metal oxide or a cyanate ester; and an overwind made of glass fiber yarn.

In some embodiments, the coiled conductor is formed from a wire that has a chemical or vapor deposited coating of non-conductive inorganic compounds i.e. aluminum oxide and silicon dioxide. In other embodiments, the coiled conductor is formed from a wire that is glass coated and drawn to the correct diameter. Preferably, the wire is a Commercial Off the Shelf (COTS) conductive wire.

In preferred embodiments, the metal oxide is Titanium dioxide. In some embodiments, the titanium dioxide comprises greater than 50% of the potting resin. In preferred embodiments the filler used in the potting resin comprises between 55% and 62% of the potting resin. In preferred embodiments, the filler is a metal oxide.

In preferred embodiments the siloxane resin in maintained in the non-ceramic phase by curing it to no more than 250° C.

In some embodiments, the leads are formed from coil wire and use a glass or mineral fiber sleeve to insulate the leads.

In another aspect, a method of making an electromagnetic coil is provided. In some embodiments, the method comprises: winding a conductor around a non-removable bobbin made entirely of ceramic to form a coiled conductor; applying a siloxane polymer resin mixed with a metal oxide to the conductor during the winding step; and winding an overwind of glass fiber yarn over the coiled conductor.

DETAILED DESCRIPTION OF THE PREFERRED EMBODIMENTS

The present patent document discloses embodiments of a coiled conductor that are designed to withstand harsh environments while still performing efficiently. The embodiments may be divided into two separate categories. One category of coiled conductors designed to withstand temperatures up to and including 300° C. and one category designed to withstand temperatures up to and including 400° C. It should be understood that numerous alternatives are included and coiled conductors may be created from any combination of the alternatives listed, along with substitutions that would be known to one skilled in the art, without departing from the intended scope of this patent document.

Figure 1:
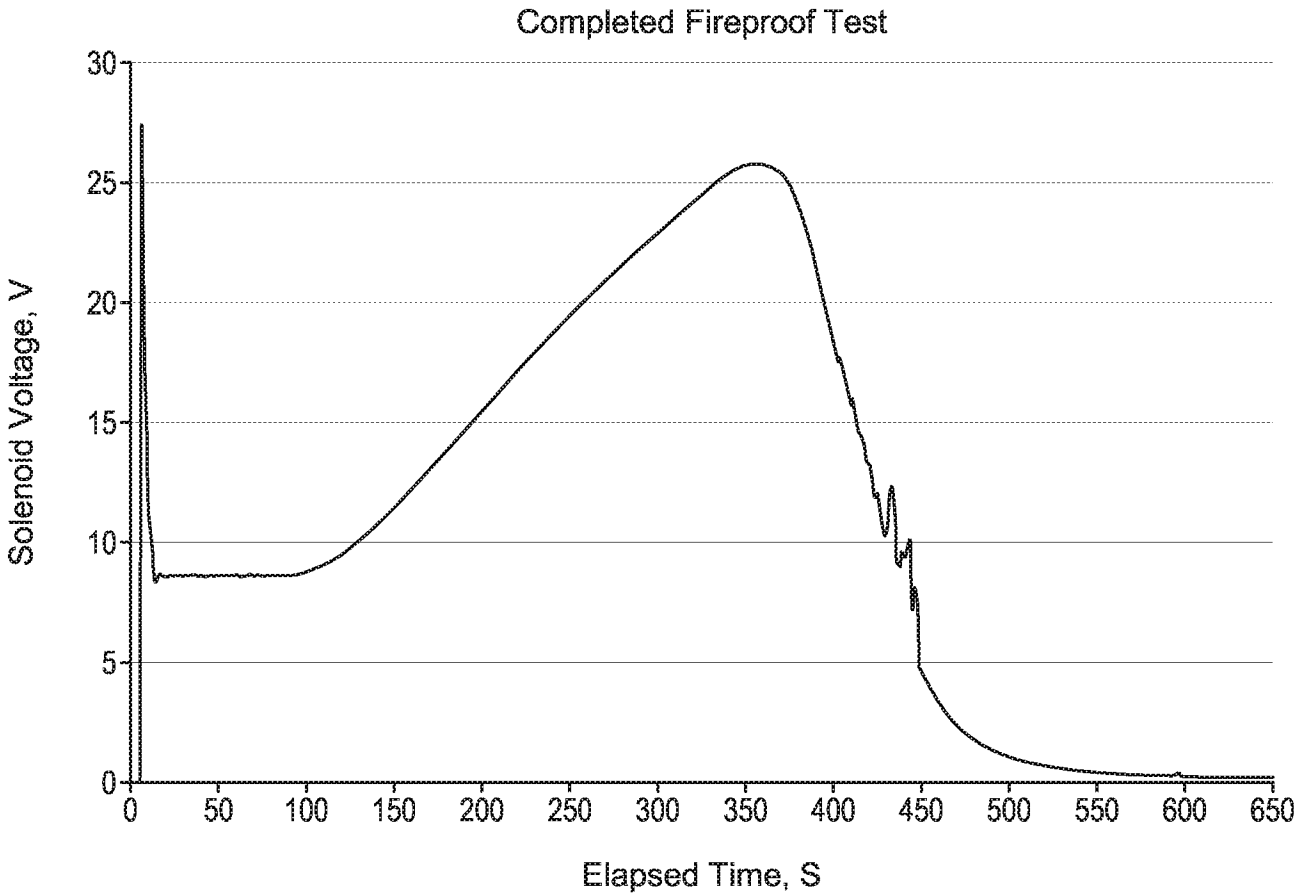
FIG. 1 is a trace from a fireproof test illustrating what typically happens when you expose conventional coils to excessive heat.
Figure 2:
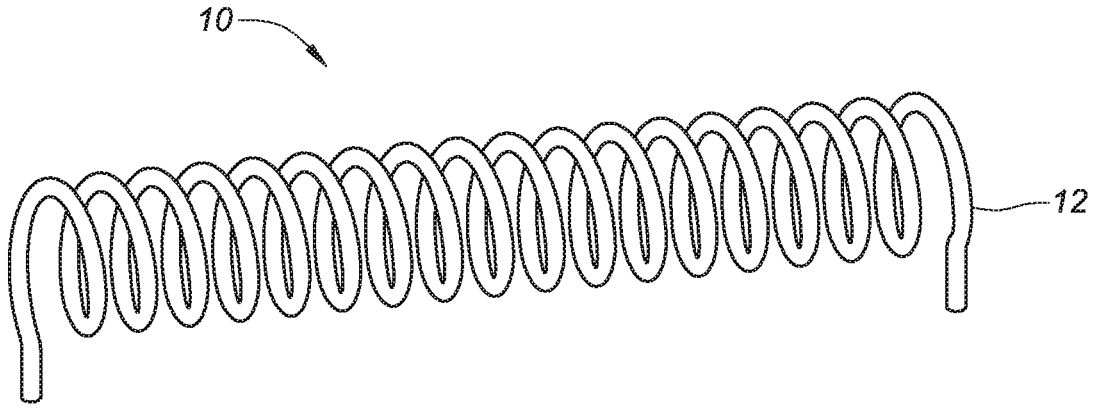
FIG. 2 illustrates an isometric view of one embodiment of a coiled conductor.

FIG. 2 illustrates a coiled conductor 10. In FIG. 2, the conductor 12 is a wire but it may be any type of conductor. The conductor 12 may be made from any type conductive material including solid nickel, nickel clad copper, copper, aluminum, silver, gold, steel, tin, or any other conductive material. In some embodiments, the conductor 12 may be coated or a plurality of materials may be combined to create a conductor 12. A polymer coating, an amorphous ceramic coating or a polycrystalline ceramic coating may be used. In some embodiments, silver plating, nickel plating, tin plating or some other type of plating may be used. The conductive wire may be made from a plurality of smaller diameter strands of wire to form conductor 12.

In preferred embodiments designed to withstand harsh environments of 300° C. or more, ceramic coated nickel clad copper wire or ceramic coated solid nickel wire may be used.

As used herein, the term "coiled conductor" means any conductor 12 in the shape of a coil, spiral or helix. The term "coiled conductor" itself does not require that the conductor 12 is wound around a core, although it may be. As may be seen in FIG. 2, the conductor 12 is wound into a coil.

If the conductor 12 is tightly wound or wound with multiple layers, the individual winds of the conductor 12 will come in contact. In such embodiments, the conductor 12 will need to have an insulating coating to prevent the individual winds of the coil from contacting each other. In preferred embodiments the conductor 12 is a COTS wire. To this end, the wire may have a ceramic coating that has been deposited by chemical or plasma vapor deposition. In some embodiments, the coating is Aluminum Oxide and Silicon Dioxide. In other embodiments, the wire may be glass coated and drawn to the correct diameter.

A large advantage of using COTS wire is the reduction of manufacturing time and costs. Unlike many of the existing designs that create electromagnetic coils that can withstand harsh environments, embodiments of the current design are not required to have a conductor that is specially coated or created in a preprocessing step. In addition, using COTS wire avoids additional ITAR issues.

Figure 3:
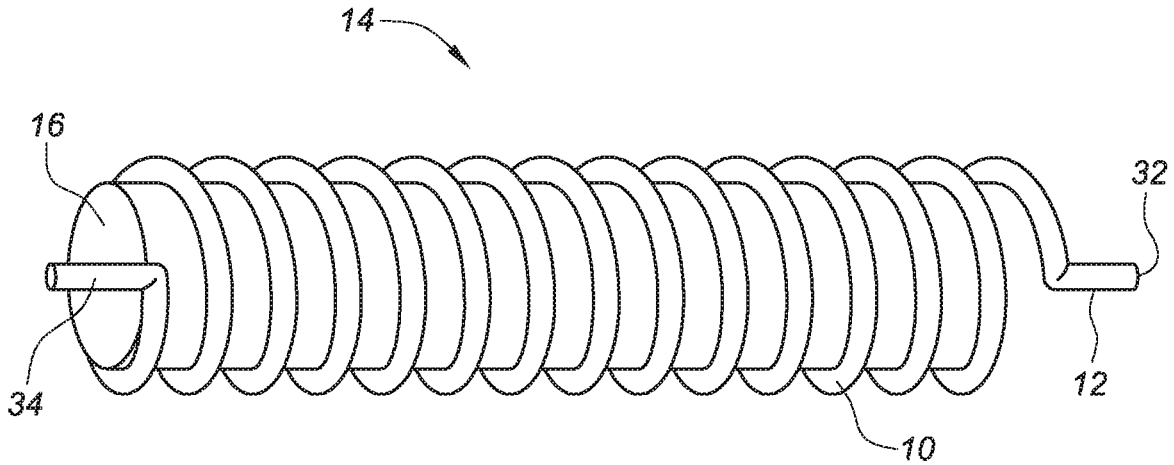
FIG. 3 illustrates an isometric view of one embodiment of an electromagnet.

FIG. 3 illustrates an isometric view of one embodiment of an electromagnetic coil 14. The electromagnetic coil 14 may also be referred to as a solenoid. As may be seen in FIG. 3, the electromagnetic coil 14 includes a conductor 12 wound in a coil around a core 16. The core 16 may also be referred to as a former or bobbin. During manufacture, the coiled conductor 10 is formed by wrapping the wire around the core 16. In some embodiments, the core 16 is just a removable support structure for forming the coiled conductor 10. However, in other embodiments the coiled conductor 10 is formed around the core 16 and the core 16 remains an integral part of the final electromagnetic coil 14.

The core 16 may be made from metal, ceramic or other types of materials. In particular, stainless steel, anodized aluminum, or Alumina may be used. The core 16 may also have insulating coatings applied. However, in preferred embodiments, the core 16 is made entirely out of a ceramic like Alumina. Manufacturing the core 16 out of a ceramic material provides a dielectric barrier to the leakage of electrical current from the coil. This increases efficiency of the coil and maintains an attractive weight budget. Ceramic cores are also highly heat resistant and allow the final product to withstand higher temperatures.

In preferred embodiments, the conductor 12 is wound in a tightly packed helix. The electromagnetic coil 14 produces a magnetic field when an electrical current is passed through the conductor.

Typical electromagnetic coils have a metallic core 16. While embodiments of the present invention may have a core made from a metal or metal alloy, preferred embodiments use a ceramic core. In the most preferred embodiments, the core 16 is made entirely of ceramic. The ceramic core is light weight and can withstand extremely high temperatures. In preferred embodiments, wire is wrapped around a non-removable ceramic bobbin 16 to form the coiled conductor 10.

Figure 4:
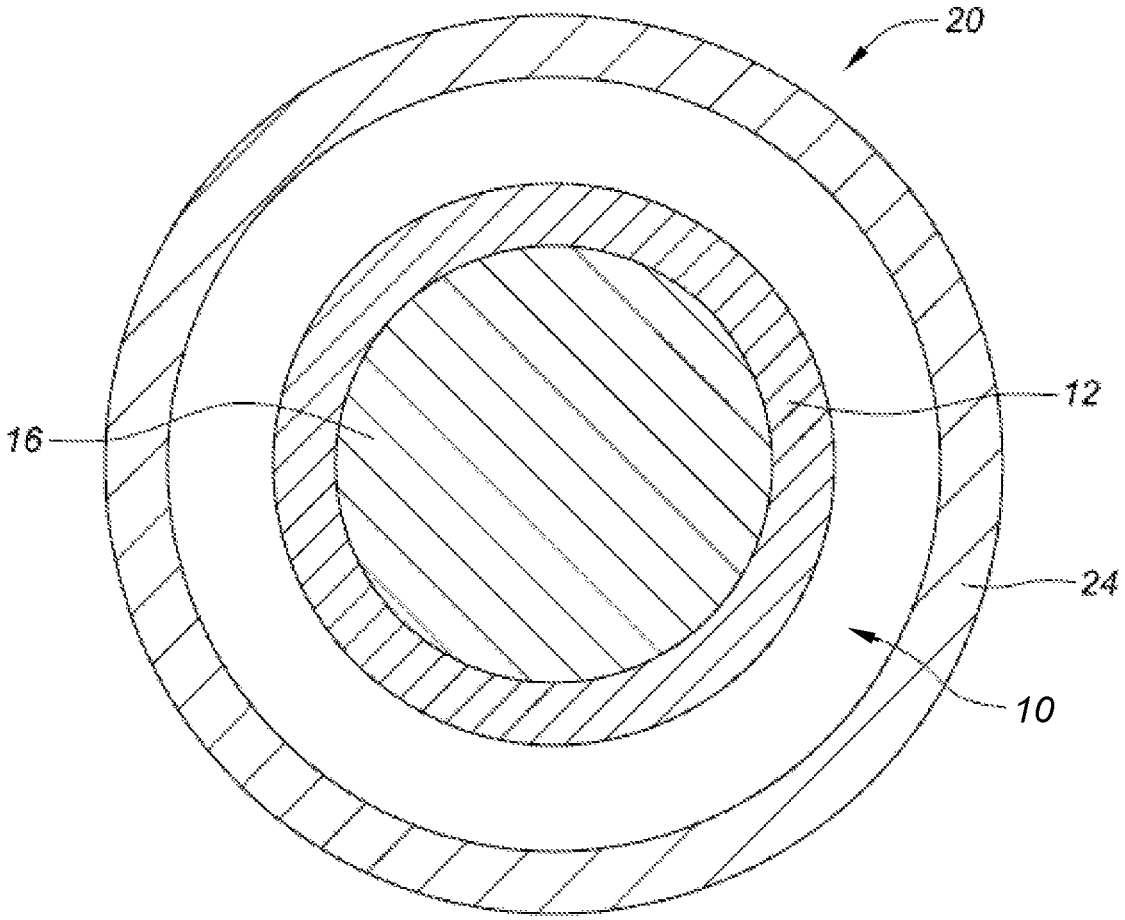
FIG. 4 illustrates a cross-sectional view of one embodiment of an electromagnet.

FIG. 4 illustrates a cross section of one embodiment of an electromagnetic coil assembly 20. The embodiment shown in FIG. 4 includes a housing 24 that encases the coiled conductor 10 and the core 16. In embodiments that do not include a housing 24, a sealant may be used to ensure the winding is resistant to environmental conditions. Typical coils may use polyurethane varnish or epoxy resin. In some embodiments, the sealant is made from a high temperature material. In preferred embodiments, designed to withstand temperature ranges up to 400° C. heat or ultraviolet labile Silsesquioxane compounds may be used. Preferred embodiments may include, but are not limited to, poly(2-Acetoxyethylsilsesquioxane), poly(2-Chloroethylsilsesquioxane or poly(2-Bromoethylsilsesquioxane).

In preferred embodiments, a resin is added during manufacture to secure the coil windings in place. The resin is applied while the wire is being wrapped on the core 16. In some embodiments, more resin may be applied to an overwind 28 to secure the overwind 28 in place as well. See FIG. 7. The resin may be brushed or sprayed on as the conductor 12 is wrapped around the bobbin 16. The resin provides strength and resistance to the environment while preventing the Lorentz force from fatiguing the wires.

Figure 6:
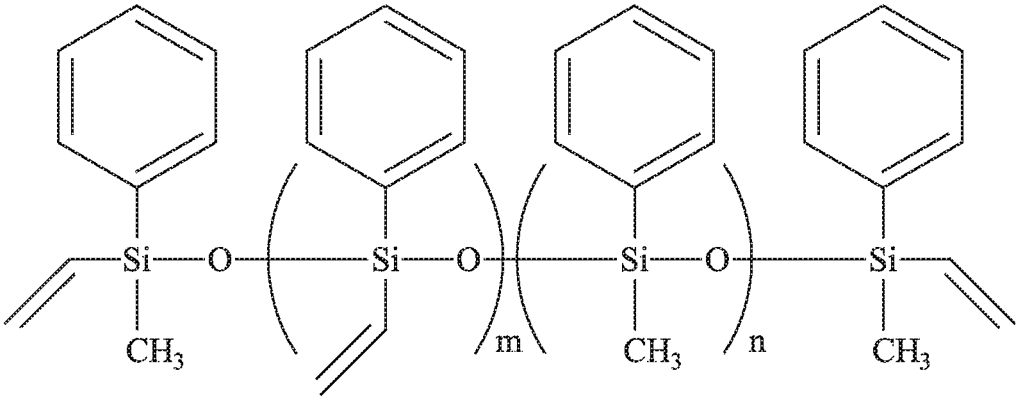
FIG. 6 illustrates a chemical diagram of a siloxane polymer resin for use with some of the embodiments described herein.

In some embodiments, the resin is based on a siloxane. In such embodiments, the resin may be a medium viscosity siloxane polymer, such that the resin may be applied directly or when thinned using solvents. In preferred embodiments, the siloxane polymer is a phenylmethyl polysiloxane resin. Such a polymer is a siloxane with methyl and phenyl pendant groups. FIG. 6 illustrates VinylPhenylMethyl Terminated VinylPhenylsiloxane-PhenylMethylsiloxane Copolymer. In preferred embodiments, the siloxane polymer may be: Vinyl Terminated Poly Dimethyl-Diphenyl siloxane copolymer, Vinyl Terminated Poly Phenylmethyl siloxane copolymer, VinylPhenylMethyl Terminated Poly VinylPhenylsiloxane-PhenylMethylsiloxane Copolymer, Hydride Terminated Poly Dimethyl-Diphenyl siloxane copolymer; or Hydride Terminated Poly Phenylmethyl siloxane copolymer. In preferred embodiments, a siloxane polymer with vinyl groups and high phenyl content are used. In one embodiment, Tego's Silikophn P 80/X is used. In another embodiment, Silres REN80 is used. Siloxane resins are readily available from manufacturers such as Tego® (www.tego.us); Wacker® (www.wacker.com), Momentive® (www.momentive.com), Bluesil® and many others.

In preferred embodiments, the siloxane is mixed with an inorganic compound to form a siloxane compound. In some embodiments, the inorganic compound is a metal oxide. In preferred embodiments, the metal oxide is Titanium Dioxide ($TiO_2$). In even more preferred embodiments the Titanium Dioxide is the Rutile polymorph. The ideal ratio of inorganic compound to base resin is between 50% and 70% filler by mass of those two components. Any greater than 70% will typically require thinning with solvents to ensure usability during manufacture. The inorganic filler is required because straight siloxane has a tendency to form bubbles and foam during curing. This is due to the release of volatile compounds into the part-cured resin. The inorganic filler serves to reduce the percentage of volatiles produced by mass and to provide channels for the volatile compounds to escape. Too little and the bubbling remains, too much and the material becomes a stiff paste. In preferred embodiments, the amount of filler is between 55% and 62%.

In the preferred embodiment the siloxanes have functional Vinyl groups where curing and crosslinking occurs. The siloxane polymer may have other additives including reagents to cause curing and cross-linking at elevated temperatures. These additives are specific to the regime used and are either Platinum or Rhodium catalysts cured between Vinyl and Hydride groups or Peroxide cured between Vinyl and Methyl groups. Platinum and Rhodium catalysts are typically added up to 250 ppm and Peroxides up to 10,000 ppm. Further cross-linking may be achieved with specific cross-linking agents. Yet further modification of the reaction process may include inhibitors and moderators. Platinum catalysts used include but are not limited to: Platinum Carbonyl Cyclovinylmethylsiloxane Complex, Platinum-Divinyltetramethyldisiloxane Complex, Platinum-Divinyltetramethyldisiloxane Complex, Platinum-Divinyltetramethyldisiloxane Complex, Platinum-Cyclovinylmethylsiloxane Complex, Platinum-Octanaldehyde/Octanol Complex and Tris(Dibutylsulfide) Rhodium Trichloride. Peroxide curing agents include but are not limited to Dichlorobenzoyl Peroxide and Dicumyl Peroxide. Crosslinking agents may include but are not limited to: Phenyltris(Dimethylsiloxy)Silane, Tetrakis(Dimethylsiloxy)Silane and Trifluoropropyltris(Dimethylsiloxy) Silane. Moderators and Inhibitors include but are not limited to: Divinyltetramethyldiloxane and Tetravinyltetramethlycyclotetrasoloxane.

In some embodiments, the base resin may be mixed with lamellar fillers such as Mica or Montmorillonite, or acicular fillers such as Wollastonite or Halloysite. These fillers may be added in ratios up to 35% by mass to the inorganic compound/base resin mixture. In some embodiments, the base resin may also be mixed with thermally stabilizing pigments such as spinelle pigments, FeMn pigments, Mangesium Aluminate or Manganese Iron Oxide. These stabilizers may be added in ratios up to 70% of the total mixture by mass. The base resin may also be further modified with solvents, de-foaming or de-aerating compounds. De-foaming and de-aerating compounds include but are not limited to (poly)Dimethyl Siloxanes, organically modified (poly) Dimethyl Siloxane and Fluorosilicones.

Figure 5:
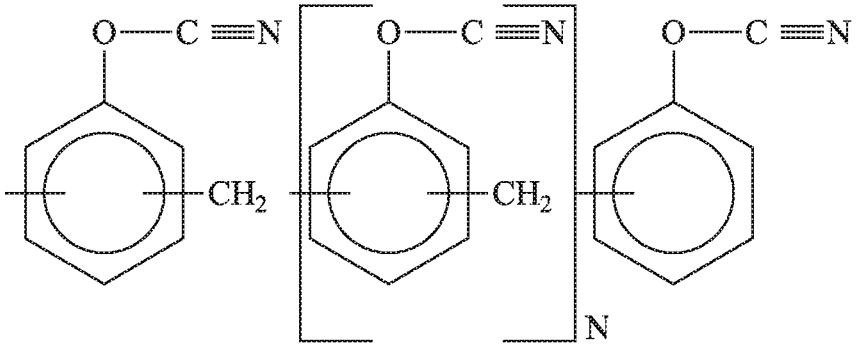
FIG. 5 illustrates a chemical diagram of a cyanate ester oligomer resin for use with some of the embodiments described herein.

If a siloxane based resin is used, the coils may be designed and manufactured to withstand temperatures up to 400° C. Siloxane based resins may be generally classified as inorganic resins. However, in other embodiments, coils may be made using a resin made from an organic compound with only slightly reduced performance. For example, a cyanate ester may be used for the resin. Such embodiments may not be as temperature resistant as the coils based on siloxane resin but may still be designed to withstand temperatures up to 300° C. In preferred embodiments. Novalec Cyanate Ester may be used. In these embodiments, the Novalec Cyanate Ester becomes a phenolic triazine post-cure. In even more preferred embodiments, Lonza Primaset PT-30 or REX-371 or similar Cyanate Esters may be used. Lonza Primaset has the chemical structure shown in FIG. 5. The Cyanate Esters described in FIG. 5 may have any number of repeating units N. However, the specific compound Lonza Primaset PT-30 has N=1 and is the most thermally stable after cure, because the short oligomer chain helps reduce the number of redistribution reactions. Accordingly, Cyanate Esters like the one shown in FIG. 5 with only a single repeating unit are preferred.

In other embodiments, other cyanate esters may be used including but not limited to: Bisphenol M Cyanate Ester; Dicyclopentadienylbisphenol Cyanate Ester; Bisphenol A Cyanate Ester; Bisphenol B Cyanate Ester; Bisphenol E Cyanate Ester, Bisphenol P Cyanate Ester; Tetramethylbisphenol F Cyanate Ester; Hexafluorobisphenol A Cyanate Ester; and Phenol Novolac Cyanate Ester. In some embodiments, the cyanate ester may be used in combination with additives. In other embodiments, no additives are used.

In yet other embodiments, other resin types may be used including Poly(p-vinyl phenol). Polyamides, Bismaleimides, and Phthalonitrile based polymers.

It should be noted that the embodiments described herein have no requirement to be able to withstand any particular temperature and reference is made to the 300° C. and 400° C. purely for reference.

Figure 7:
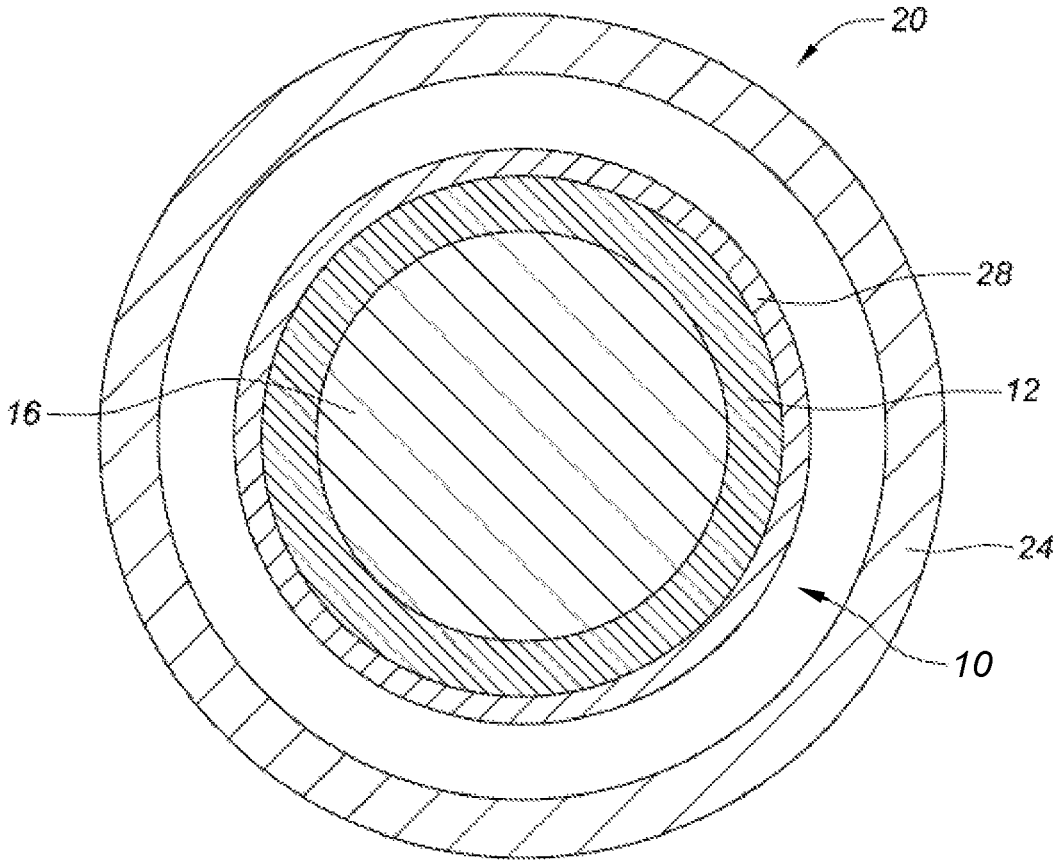
FIG. 7 illustrates another cross-sectional view of one embodiment of an electromagnet.

FIG. 7 illustrates a cross-sectional view of the embodiment of FIG. 4 further comprising an overwind 28. In some embodiments, the electromagnetic conductor 20 may further include an overwind 28. The overwind 28 provides environmental protection for the coiled conductor 10. In preferred embodiments, the overwind 28 is made from a glass or ceramic fiber yarn that is wound around the coiled conductor 10. As discussed above, resin may be applied to the overwind 28 to further secure the overwind 28 and improve its protective qualities.

Because of the materials used and the desired final qualities of those materials, embodiments of the present patent document may be cured at much lower temperatures than conventional high temperature coils. Cure temperatures for the embodiments described herein may be approximately 250° C. for not less than 30 minutes. Accordingly, embodiments herein do not require a siloxane resin cured to a fully ceramic phase whereby all organic pendant groups are eliminated from the cured matrix.

Returning to FIG. 3, it may be seen that the coiled conductor 10 has leads 32 and 34. Leads 32 and 34 are simply the ends of the coiled conductor 10 that are used to electrically connect the coiled conductor 10 into a larger electrical system. As one skilled in the art will appreciate, leads 32 and 34 may be located outside the housing 24 of the coiled conductor 10.

In traditional designs, the leads 32 and 34 are created by using terminal posts on the coil. However, in the embodiments described herein, the leads 32 and/or 34 may be formed from coil wire using a glass or mineral fiber sleeve to insulate the leads 32 and/or 34.

In some embodiments, the coil leads may be formed during the assembly process whereby a single strand of the coil wire, or a loop flattened to contrive a multitude of strands, is surrounded by an insulating sleeve of glass or ceramic fiber which is fed through an aperture in the cheeks of the bobbin or radially secured to the bobbin prior and subsequent to winding to make the leads. In other embodiments the coil wires are terminated via a terminal post or splice to COTS lead wires.

Although the inventions have been described with reference to preferred embodiments and specific examples, it will readily be appreciated by those skilled in the art that many modifications and adaptations of the methods and devices described herein are possible without departure from the spirit and scope of the inventions as claimed hereinafter. Thus, it is to be clearly understood that this description is made only by way of example and not as a limitation on the scope of the invention.

What is claimed is:

1. An electromagnetic coil comprising:

a bobbin made of ceramic;

a coiled conductor wrapped around the bobbin;

a potting resin applied to the coiled conductor from the bobbin outward wherein, the potting resin is a siloxane polymer mixed with a metal oxide; and an overwind made of glass fiber yarn.

2. The electromagnetic coil of claim 1, wherein the coiled conductor is formed from a wire that has a chemical or vapor deposited coating of non-conductive inorganic compounds.

3. The electromagnetic coil of claim 1, wherein the coiled conductor is formed from a wire that is glass coated.

4. The electromagnetic coil of claim 1, wherein the metal oxide is Titanium dioxide.

5. The electromagnetic coil of claim 4, wherein Titanium dioxide comprises greater than 50% of the potting resin.

6. The electromagnetic coil of claim 1, wherein the siloxane resin is maintained in the non-ceramic phase.

7. The electromagnetic coil of claim 1, further comprising leads formed from coil wire that use a glass sleeve to insulate the leads.

8. The electromagnetic coil of claim 1, further comprising leads formed from coil that use a mineral fiber sleeve to insulate the leads.

9. The electromagnetic coil of claim 1, wherein metal oxide comprises between 55% and 62% of the potting resin.

10. An electromagnetic coil comprising:

a bobbin made of ceramic;

a coiled conductor wrapped around the bobbin;

a potting resin applied to the coiled conductor from the bobbin outward wherein, the potting resin is a siloxane polymer mixed with a filler and the filler comprises between 55% and 62% of the potting resin; and an overwind made of glass fiber yarn.

11. The electromagnetic coil of claim 10, wherein the siloxane resin is maintained in the non-ceramic phase.

* * * * *